US009601049B2

(12) United States Patent
Park et al.

(10) Patent No.: US 9,601,049 B2
(45) Date of Patent: Mar. 21, 2017

(54) ORGANIC LIGHT EMITTING DISPLAY DEVICE FOR GENERATING A PORCH DATA DURING A PORCH PERIOD AND METHOD FOR DRIVING THE SAME

(71) Applicant: Samsung Display Co., Ltd., Yongin, Gyeonggi-Do (KR)

(72) Inventors: Kyong-Tae Park, Suwon-si (KR); Jin-Yup Kim, Cheonan-si (KR); Eun-Kyung Yang, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 23 days.

(21) Appl. No.: 14/666,161

(22) Filed: Mar. 23, 2015

(65) Prior Publication Data

US 2016/0125798 A1 May 5, 2016

(30) Foreign Application Priority Data

Oct. 29, 2014 (KR) ..... 10-2014-0148116

(51) Int. Cl.
*G09G 3/32* (2016.01)
*G09G 3/34* (2006.01)

(52) U.S. Cl.
CPC ..... *G09G 3/3208* (2013.01); *G09G 3/3413* (2013.01); *G09G 2310/0202* (2013.01);
(Continued)

(58) Field of Classification Search
CPC ..... G09G 3/3208; G09G 3/3413
(Continued)

(56) References Cited

U.S. PATENT DOCUMENTS

2004/0119672 A1* 6/2004 Lee ..... G09G 3/3688 345/87
2009/0262048 A1* 10/2009 Park ..... G09G 3/006 345/76

(Continued)

FOREIGN PATENT DOCUMENTS

JP 2006-349873 12/2006
JP 2009-58592 A 3/2009

(Continued)

OTHER PUBLICATIONS

EPO Search Report dated Apr. 7, 2016, for corresponding European Patent application 15165608.9, (8 pages).

(Continued)

*Primary Examiner* — Long D Pham
(74) *Attorney, Agent, or Firm* — Lewis Roca Rothgerber Christie LLP

(57) ABSTRACT

An organic light emitting display device including a display panel including a plurality of scan lines, first through (M)th data lines crossing the scan lines, and a plurality of pixels, where M is an integer greater than 1, a scan driver configured to provide scan signals to the pixels through the plurality of scan lines, a data driver configured to provide data signals to the pixels through the first through (M)th data lines, and a porch data generator configured to generate porch data based on an average value of at least a portion of frame data, and to provide the porch data to the data driver, wherein the data driver is configured to generate the data signals based on the porch data during a porch period, and to generate the data signals based on the frame data during an active period.

12 Claims, 20 Drawing Sheets

(52) U.S. Cl.
CPC ..... *G09G 2320/0209* (2013.01); *G09G 2320/0219* (2013.01)

(58) Field of Classification Search
USPC ..... 345/77, 82
See application file for complete search history.

(56) References Cited

U.S. PATENT DOCUMENTS

| | | | | |
|---|---|---|---|---|
| 2010/0066728 | A1* | 3/2010 | Oohira | G09G 3/3648 345/214 |
| 2012/0200551 | A1* | 8/2012 | Liu | G09G 3/3611 345/211 |
| 2013/0135282 | A1* | 5/2013 | Jeon | G09G 3/3696 345/212 |
| 2013/0222437 | A1* | 8/2013 | Ka | G09G 3/3233 345/690 |

FOREIGN PATENT DOCUMENTS

| | | | |
|---|---|---|---|
| KR | 10-2007-0057782 | A | 6/2007 |
| KR | 10-2007-0076344 | A | 7/2007 |
| KR | 10-2008-0015084 | A | 2/2008 |
| KR | 10-2008-0066421 | A | 7/2008 |
| KR | 10-2008-0066431 | A | 7/2008 |
| KR | 10-2010-0066808 | A | 6/2010 |

OTHER PUBLICATIONS

English machine translation of relevant parts of Japanese Publication 2006-349873 dated Dec. 28, 2006, listed above, (1 page).
English machine translation of relevant parts of Korean Publication 10-2008-0066431 dated Jul. 16, 2008, previously submitted in an IDS dated Mar. 23, 2015 with English Abstract, (1 page).

* cited by examiner

ORGANIC LIGHT EMITTING DISPLAY DEVICE FOR GENERATING A PORCH DATA DURING A PORCH PERIOD AND METHOD FOR DRIVING THE SAME

CROSS REFERENCE TO RELATED APPLICATION

This application claims priority to and the benefit of Korean patent Application No. 10-2014-0148116, filed on Oct. 29, 2014, the disclosure of which is hereby incorporated by reference herein in its entirety.

BACKGROUND

1. Field

Aspects of embodiments of the inventive concept relate to display devices. More particularly, aspects of embodiments of the inventive concept relate to an organic light emitting display device and a method for driving the organic light emitting display device.

2. Description of the Related Art

An organic light emitting diode (OLED) includes an organic emission layer between two electrodes, namely, an anode and a cathode. Positive holes from the anode are combined with electrons from the cathode in the organic emission layer between the anode and the cathode to emit light. The OLED has a variety of advantages such as a wide viewing angle, a rapid response speed, relatively thin thickness, and low power consumption.

An organic light emitting display device includes a display panel and a driver. The display panel includes a plurality of scan lines, a plurality of data lines, and a plurality of pixels. The driver includes a scan driver providing scan signals to the scan lines and a data driver providing data signals to the data lines.

Pixel circuits in the organic light emitting display device that is driven by a digital driving technique has a relatively simple structure. On the other hand, pixel circuits in the organic light emitting display device that is driven by an analog driving technique has a relatively complicated structure to stably display an image. Therefore, the organic light emitting display device that is driven by the analog driving technique has a low opening ratio, especially in a high resolution display panel. When line to line spacing of the pixel circuit is reduced to increase the opening ratio of the organic light emitting display device, crosstalk may occur by an electrical coupling between the lines. As a result, a voltage of a gate electrode of the driving transistor may change, thereby degrading the display quality.

SUMMARY

Aspects of embodiments of the present inventive concept are directed to an organic light emitting display device capable of alleviating or removing a stripe pattern resulting from crosstalk.

Aspects of embodiments of the present inventive concept are further directed to a method for driving the organic light emitting display device.

According to some example embodiments, there is provided an organic light emitting display device including: a display panel including a plurality of scan lines, first through (M)th data lines crossing the scan lines, and a plurality of pixels, where M is an integer greater than 1; a scan driver configured to provide scan signals to the pixels through the plurality of scan lines; a data driver configured to provide data signals to the pixels through the first through (M)th data lines; and a porch data generator configured to generate porch data based on an average value of at least a portion of frame data, and to provide the porch data to the data driver, wherein the data driver is configured to generate the data signals based on the porch data during a porch period, and to generate the data signals based on the frame data during an active period.

In an embodiment, the porch data generator is configured to generate the porch data for a (K)th data line of the data lines by calculating an average value of the frame data for the (K)th data line, where K is an integer between 1 and M.

In an embodiment, the porch data generator is further configured to set the porch data for the (K)th data line to an average value of the frame data corresponding to all of ones of the pixels connected to the (K)th data line.

In an embodiment, the porch data generator is further configured to set the porch data for the (K)th data line to an average value of the frame data corresponding to ones of the pixels connected to the (K)th data line.

In an embodiment, the porch data generator is further configured to set the porch data for the (K)th data line to an average value of the frame data corresponding to randomly selected ones of the pixels connected to the (K)th data line.

In an embodiment, the plurality of pixels are grouped into a plurality of pixel groups each including ones of the pixels emitting a same color light, and the porch data generator is further configured to generate the porch data for each pixel group by calculating an average value of the frame data for each pixel group.

In an embodiment, the porch data generator is further configured to set the porch data to an average value of the frame data corresponding to ones of the pixels in each pixel group.

In an embodiment, the porch data generator is further configured to set the porch data to an average value of the frame data corresponding to randomly selected ones of the pixels in each pixel group.

In an embodiment, the pixels include a first column of pixels connected to a first data line of the data lines and configured to emit a first color light, a second column of pixels connected to a second data line of the data lines and configured to emit a second color light, and a third column of pixels connected to a third data line of the data lines and configured to emit a third color light, and the first color light, the second color light, and the third color light are different from each other.

In an embodiment, the porch data generator is further configured to generate the porch data by calculating average values of the frame data for corresponding ones of the first column of pixels, the second column of pixels, and the third column of pixels.

In an embodiment, the porch data generator is further configured to generate the porch data by calculating average values of the frame data for corresponding ones of the first color light, the second color light, and the third color light.

In an embodiment, the pixels include a first column of pixels connected to a first data line of the data lines and configured to alternately emit a first color light and a second color light, and a second column of pixels connected to a second data line of the data lines and configured to emit a third color light, wherein the first color light, the second color light, and the third color light are a red color light, a blue color light, and a green color light, respectively.

In an embodiment, the porch data generator is further configured to generate the porch data by calculating average values of the frame data for corresponding ones of the first color light, the second color light, and the third color light, wherein the porch data generator is further configured to alternately set the porch data for the first column of pixels to an average value of the frame data corresponding to the first color light and an average value of the frame data corresponding to the second color light, and wherein the porch data generator is further configured to set the porch data for the second column of pixels to an average value of the frame data corresponding to the third color light.

In an embodiment, the display device further includes a line selector connected between the data driver and the display panel, wherein the line selector is configured to selectively provide the data signals to first ones of the data lines and second ones of the data lines in response to a line selection signal.

In an embodiment, the porch data generator is further configured to generate the porch data for the first ones of the data lines by calculating an average value of the frame data corresponding to one of the pixels connected to the first ones of the data lines, and to generate the porch data for the second ones of the data lines by calculating an average value of the frame data corresponding to ones of the pixels connected to the second ones of the data lines.

In an embodiment, the display device further includes: an emission driver configured to provide an emission signal to the pixels, wherein the porch period and an on-period of the emission signal are partially overlapped.

According to some example embodiments, there is provided a method for driving an organic light emitting display device including a plurality of pixels, the method including: generating porch data, by a porch data generator, based on an average value of at least a portion of frame data; providing data signals, by a data driver, corresponding to the porch data to the pixels during a porch period; and providing the data signals, by the data driver, corresponding to the frame data to the pixels during an active period.

In an embodiment, generating the porch data includes: calculating, by the porch data generator, average values of the frame data for corresponding ones of a plurality of data lines; and generating, by the porch data generator, the porch data for each data line based on a corresponding one of the average values.

In an embodiment, the porch data generator is configured to set the porch data for each of the data lines to an average value of the frame data corresponding to randomly selected ones of the pixels connected to each of the data lines.

In an embodiment, the plurality of pixels are grouped into a plurality of pixel groups each including the pixels emitting a same color light, and wherein generating the porch data includes: calculating, by the porch data generator, average values of the frame data for corresponding ones of the pixel groups; and generating, by the porch data generator, the porch data for each pixel group based on a corresponding one of the average values.

Therefore, an organic light emitting display device according to example embodiments generates porch data based on an average value of at least a portion of the frame data, thereby reducing the effect of crosstalk by a parasitic capacitor in a data line. The organic light emitting display device alleviates or removes a stripe pattern that occurs by outputting data signals during a porch period.

In addition, a method for driving the organic light emitting display device improves (e.g., increases) a display quality in a low luminance driving mode using a dimming technique such as a method of controlling the light emission.

BRIEF DESCRIPTION OF THE DRAWINGS

Some exemplary embodiments of the present inventive concept will be described more fully hereinafter with reference to the accompanying drawings, in which various embodiments are shown.

DETAILED DESCRIPTION

Figure 1:
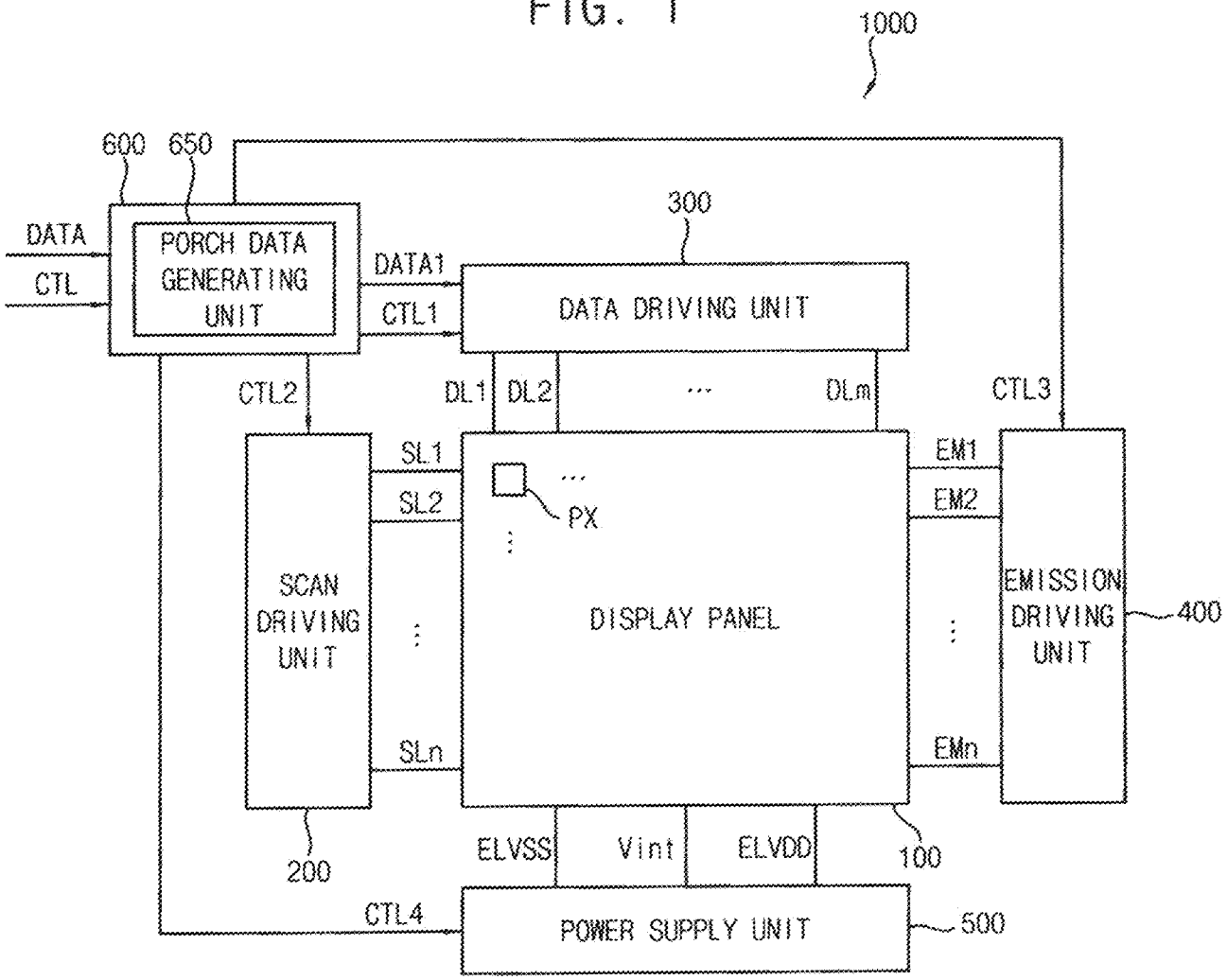
FIG. 1 is a block diagram illustrating an organic light emitting display device according to some example embodiments of the present inventive concept.

Exemplary embodiments will be described more fully hereinafter with reference to the accompanying drawings, in which various embodiments are shown.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

FIG. 1 is a block diagram illustrating an organic light emitting display device according to some example embodiments of the present inventive concept.

Referring to FIG. 1, the organic light emitting display device 1000 may include a display panel 100, a scan driver (e.g., a scan driving unit) 200, a data driver (e.g., a data driving unit) 300, an emission driver (e.g., an emission driving unit) 400, a power supply (e.g., a power supply unit) 500, a controller 600, and a porch data generator (e.g., a porch data generating unit) 650.

The display panel 100 may be connected to the scan driver 200 via a plurality of scan lines SL1 through SLn. The display panel 100 may be connected to the data driver 300 via a plurality of data lines DL1 through DLm. The display panel 100 may be connected to the emission driver 400 via a plurality of emission lines EM1 through EMn. The display panel 100 may include n×m pixels PX because the pixels PX are arranged at locations corresponding to crossing regions of the scan lines SL1 through SLn and the data lines DL1 through DLm.

The scan driver 200 may provide scan signals to the pixels PX via the scan lines SL1 through SLn.

The data driver 300 may provide data signals to the pixels PX via the data lines DL1 through DLm. The data driver 300 may receive output image data DATA1 including frame data and porch data from the controller 600. The data driver 300 may generate the data signals based on the porch data during a porch period. The data driver 300 may provide the data signals corresponding to the porch data to the pixels PX during the porch period. Here, the porch period refers to a period in which frame data for displaying an image are not outputted to adjust synchronization between frames. Also, the data driver 300 may generate the data signals based on the frame data during an active period. The data driver 300 may provide the data signals corresponding to the frame data to the pixels PX during the active period. Here, the active period refers to a period in which the frame data for displaying the image are outputted.

The emission driver 400 may provide emission signals to the pixels PX via the emission lines EM1 through EMn.

The power supply 500 may provide a high power voltage ELVDD, a low power voltage ELVSS, and an initialization voltage Vint to the pixels PX via power lines.

The controller 600 may control at least one of selected from the scan driver 200, the data driver 300, the emission driver 400, and the power supply 500. The controller 600 may receive input control signal CTL and input image data DATA from an image source, such as an external graphic device. The input control signal CTL may include a master clock signal, a vertical synchronization signal, a horizontal synchronization signal, and a data enable signal, etc. In addition, the controller 600 may generate output image data DATA1 and a plurality of timing control signals CTL1 through CTL4. The controller 600 may provide the output image data DATA1 and the timing control signals CTL1 through CTL4 to the scan driver 200, the data driver 300, the emission driver 400, and the power supply 500 for controlling thereof.

The porch data generator 650 may generate the porch data based on an average value of at least a portion of the frame data. The porch data generator 650 may provide the porch data to the data driver 300. The data signal corresponding to the porch data may be provided to the pixels PX from a starting point of on-period of the vertical synchronization signal until frame data of next frame period are inputted. The porch data may be generated based on an average value of the frame data for each frame period. In one example embodiment, the porch data generator 650 may generate the porch data for a (K)th data line by calculating an average value of the frame data for a (K)th data line, where K is an integer between 1 and M. In another example embodiment, the pixels PX may be grouped into a plurality of pixel groups each including pixels emitting a same color light, and the porch data generator 650 may generate the porch data for each pixel group by calculating an average value of the frame data for each pixel group. Hereinafter, methods for generating the porch data by the porch data generator 650 will be described in further detail with reference to the FIGS. 4A through 5C.

The porch data generator 650 in the organic light emitting display device 1000 may generate porch data based on an average value of at least a portion of frame data. Therefore, the organic light emitting display device 1000 may reduce an effect of crosstalk by a parasitic capacitor in the data line. The organic light emitting display device 1000 may remove or lessen a stripe pattern that occurs by outputting the data signals during the porch period.

Although the example embodiments of FIG. 1 describe that the porch data generator 650 may be included in the controller 600, the porch data generator 650 is located outside of the controller 600 or is included in an integrated circuit integrating the controller 600 and the data driver 300.

Figure 2:
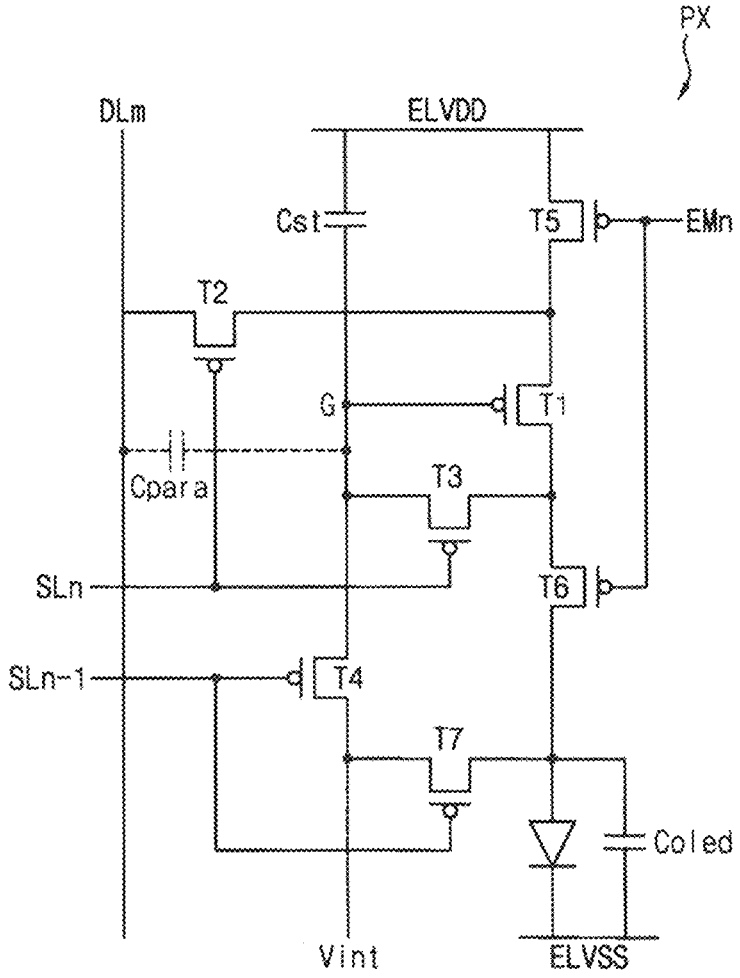
FIG. 2 is a circuit diagram illustrating one example of a pixel included in an organic light emitting display device of FIG. 1.
Figure 3:
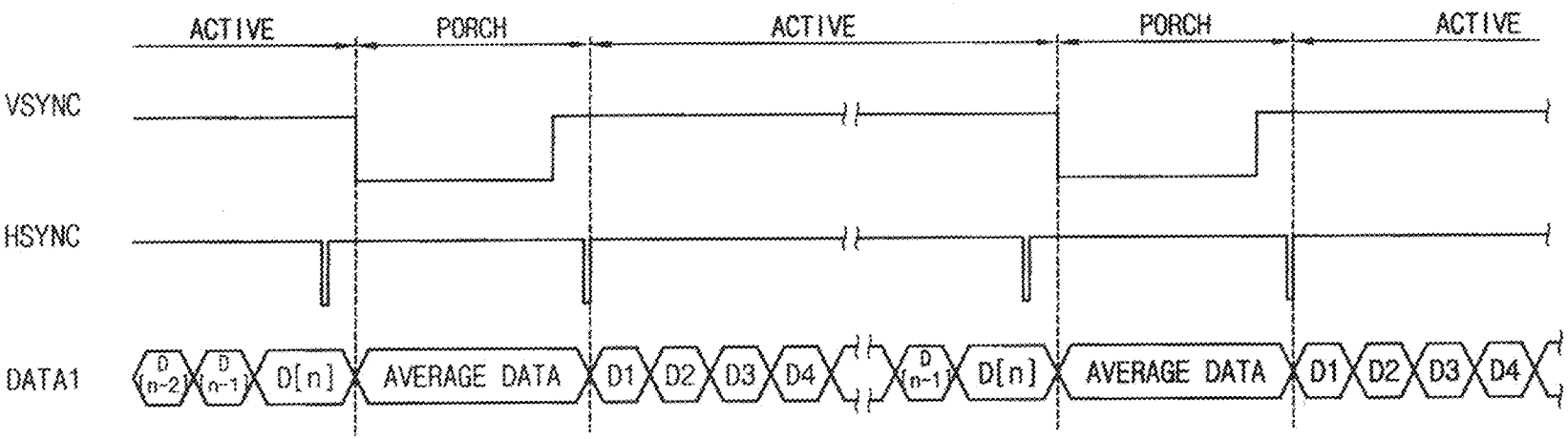
FIG. 3 is a waveform illustrating an example of providing porch data in a porch period.

FIG. 2 is a circuit diagram illustrating one example of a pixel included in an organic light emitting display device of FIG. 1. FIG. 3 is a waveform illustrating an example of providing porch data in a porch period.

Referring to FIGS. 2 and 3, the porch data are set to an average voltage of the data signals to reduce an effect of crosstalk by a parasitic capacitor in a pixel circuit.

As shown in FIG. 2, the pixel PX may include a plurality of transistors T1 through T7 and a plurality of capacitors Cst and Coled. For example, the display pixel PX may include a first transistor T1 connected between the a high power voltage ELVDD and an anode electrode of an organic light emitting diode, whereby the first transistor T1 applies a driving current corresponding to a data signal to the organic light emitting diode; a second transistor T2 connected between a source electrode of the first transistor T1 and a data line DLm; a third transistor T3 connected between a gate electrode and a drain electrode of the first transistor T1; a fourth transistor T4 connected between an initialization voltage Vint and the gate electrode of the first transistor T1; a fifth transistor T5 connected between the high power voltage ELVDD and the source electrode of the first transistor T1; a sixth transistor T6 connected between the drain electrode of the first transistor T1 and the anode electrode of the organic light emitting diode; and a seventh transistor T7 connected between the initialization voltage Vint and the anode electrode of the organic light emitting diode.

For example, the fourth transistor T4 may apply the initialization voltage Vint to the driving capacitor Cst and the gate electrode of the first transistor T1 in response to the (N−1)th scan signal so as to reset the driving capacitor Cst and the gate electrode of the first transistor T1 as the initialization voltage Vint. The seventh transistor T7 may apply the initialization voltage Vint to the anode electrode of the organic light emitting diode in response to the (N−1)th scan signal to reset the anode electrode of the organic light emitting diode as the initial voltage Vint.

The second transistor T2 may apply the data signal to the first transistor T1 in response to the (N)th scan signal.

The third transistor T3 may compensate a threshold voltage of the first transistor T1 in response to the (N)th scan signal by connecting the gate electrode and the drain electrode of the first transistor T1 (i.e., a diode connection of the first transistor T1). Because the second transistor T2 and the third transistor T3 may receive the (N)th scan signal, the data signal may be applied while the threshold voltage of the first transistor T1 is compensated.

The first transistor T1 may provide the driving current corresponding to the data signal to the organic light emitting diode.

The sixth transistor T6 may be located between the drain electrode of the first transistor T1 and the anode electrode of the organic light emitting diode. The sixth transistor T6 may control light emission of the organic light emitting diode in response to a (N)th emission signal.

In a high resolution display panel, line to line spacing of the pixel circuit may be reduced to increase the opening ratio of the organic light emitting display device. Because the data line DLm is located substantially in parallel with a G node line of a G node connected to gate electrode of the first transistor T1 (i.e., driving transistor), a parasitic capacitor Cpara may be formed between the G node line and the data line DLm. When capacitance of the parasitic capacitor Cpara is relatively large, the voltage of the gate electrode of the first transistor T1 may change due to crosstalk.

For example, a voltage of the G node connected to the gate electrode of the first transistor T1 may be calculated using [Equation 1] below, $$V_{node(G)} = V_{data} - |V_{th}| + \frac{0.5C_{oxT3}}{C_{total(G)}}(VGH - VGL) + V_{crosstalk}, \quad \text{Equation 1}$$

wherein $V_{node(G)}$ is the voltage of the G node, $V_{data}$ is a voltage of the data signal, $V_{th}$ is a threshold voltage of the first transistor T1, $C_{oxT3}$ is a capacitance of the oxide layer of the third transistor T3, $C_{total(g)}$ is a total capacitance of the G node line, VGH is a high power voltage of the scan signal, VGL is a low power voltage of the scan signal, and $V_{crosstalk}$ is a magnitude of voltage change due to crosstalk.

The voltage of the G node line may be affected by the crosstalk. When the voltage of the G node (i.e., a voltage of the gate electrode of the first transistor T1) is changed, an amount of the driving current flowed through the first transistor T1 may be changed. Therefore, a luminance of the organic light emitting diode may be changed due to crosstalk, and the stripe pattern may be recognized by a viewer.

For example, the magnitude of voltage change due to crosstalk in the active period may be calculated using [Equation 2] below, $$V_{crosstalk} = \frac{C_{data-node(G)}}{C_{total(G)}}(V_{node(G)} - AVG(V_{data})), \quad \text{Equation 2}$$

Wherein $V_{crosstalk}$ is the magnitude of the voltage change due to crosstalk in the active period, $C_{data\text{-}node(g)}$ is a capacitance between the data line and the G node line, $C_{total(g)}$ is a total capacitance of the G node line, $V_{node(g)}$ is the voltage of the G node line, and $AVG(V_{data})$ is the average voltage of the data signals corresponding to each frame period.

The magnitude of the voltage change due to crosstalk in the active period may be in proportional to a voltage difference between the G node line and the data signal. Thus, a coupling effect may occur based on the average voltage of the data signals corresponding to each frame period in the active period.

On the other hand, when the organic light emitting diode emits light in the porch period, the magnitude of the voltage change due to crosstalk may be calculated using [Equation 3] below, $$V_{crosstalk} = \frac{C_{data-node(G)}}{C_{total(G)}}(V_{node(G)} - V_{porchdata}) \quad \text{Equation 3}$$

Wherein, $V_{crosstalk}$ is the magnitude of the voltage change due to crosstalk in the porch period, $C_{data\text{-}node(g)}$ is the capacitance between the data line and the G node line, $C_{total(g)}$ is the total capacitance of the G node line, $V_{node(g)}$ is the voltage of the G node, and $V_{porchdata}$ is a voltage of the porch data.

Therefore, the magnitude of the voltage change due to crosstalk in the porch period may be proportional to the voltage difference between the G node line and the voltage of the porch data. Thus, the coupling effect may occur based on the voltage of the porch data in the porch period.

As shown in FIG. 3, to remove or lessen the stripe pattern, the voltage change due to crosstalk in the porch period PORCH may be adjusted to substantially the same as the voltage change due to crosstalk in the active period ACTIVE. In consideration of [Equation 2] and [Equation 3], the porch data may be set to an average value of the data signal (i.e., $V_{porchdata}$=AVG($V_{data}$)) such that the voltage change due to crosstalk in porch period PORCH is substantially the same as the voltage change due to crosstalk in the active period ACTIVE. Therefore, the stripe pattern may not be recognized by viewers.

Therefore, the porch data may be generated based on an average value of at least a portion of the frame data, thereby efficiently reducing the effect of crosstalk.

Although the example embodiments of FIG. 2 describe that the pixel include seven transistors and two capacitors, the pixel may have a variety of structures in which the crosstalk occur by the data line.

Figure 4A:
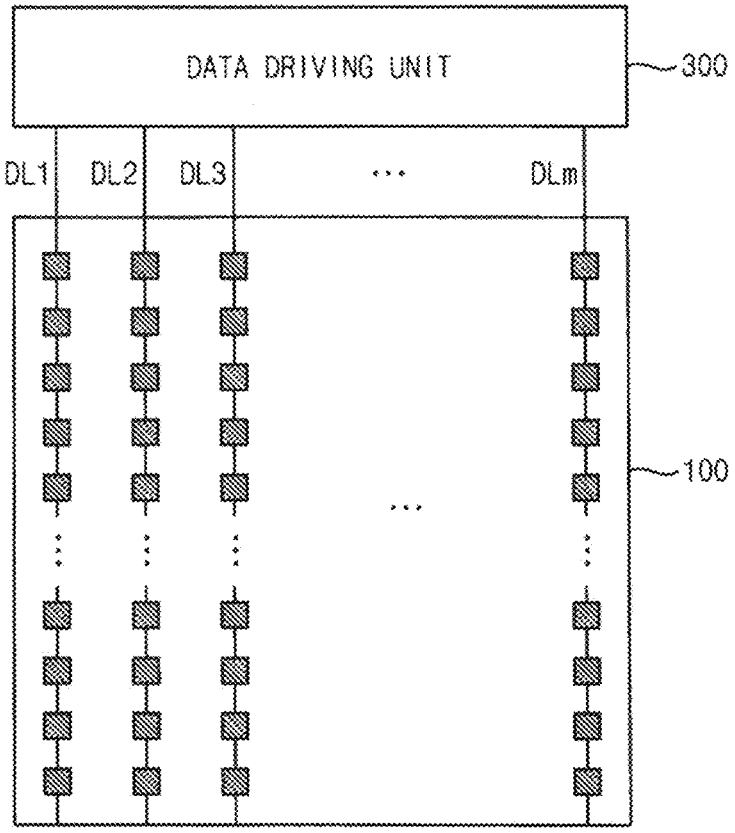
FIGS. 4A through 4C are diagrams illustrating examples of generating porch data by calculating average values of the frame data for each of the data lines.
Figure 4B:
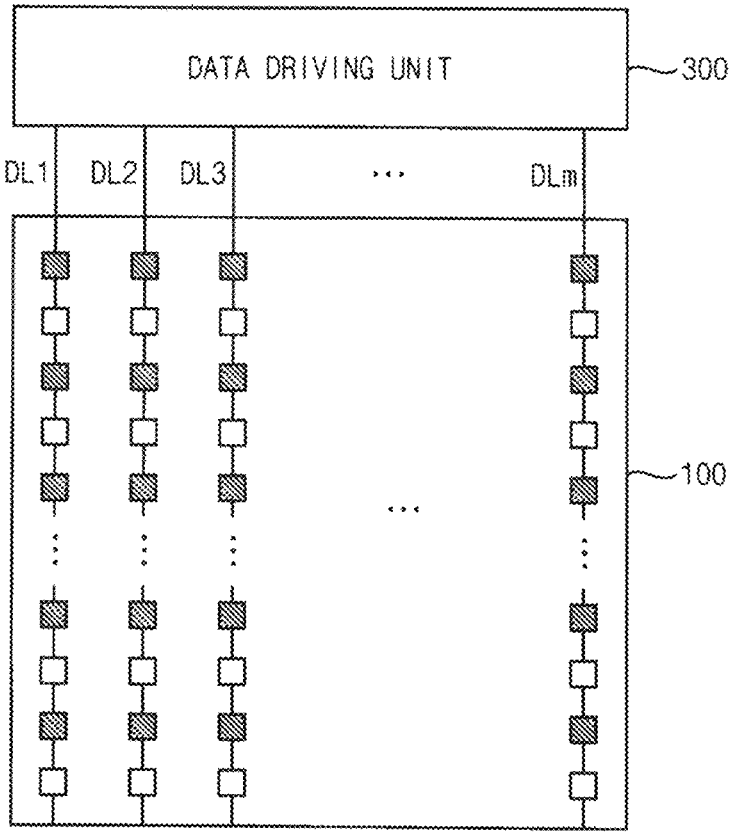
Figure 4C:
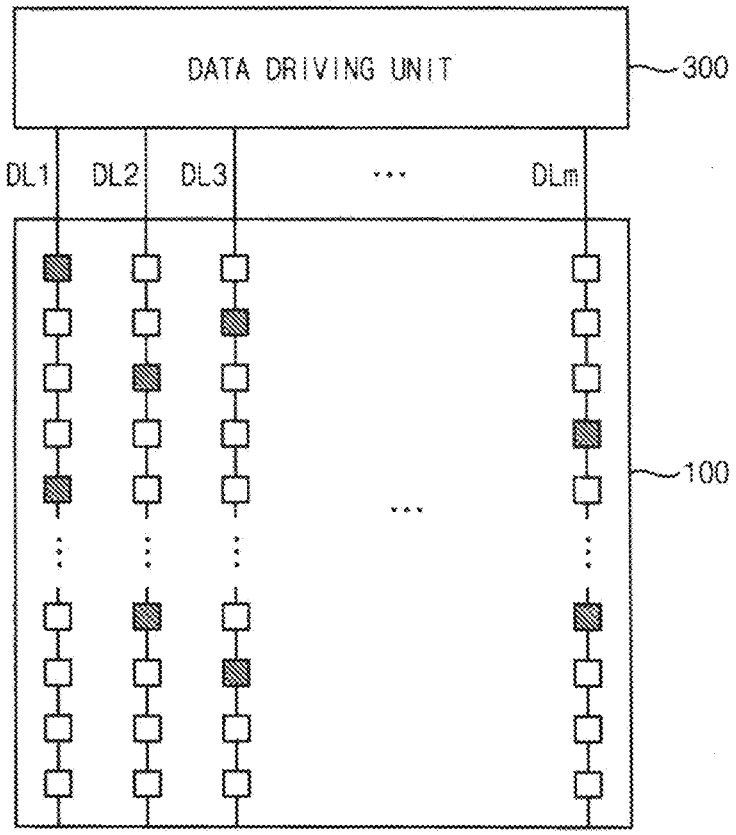

FIGS. 4A through 4C are diagrams illustrating examples of generating porch data by calculating average values of the frame data for each of the data lines.

Referring to FIGS. 4A through 4C, the porch data generator 650 may generate the porch data for a (K)th data line by calculating an average value of the frame data for a (K)th data line, where K is an integer between 1 and M. Thus, average values of the frame data for corresponding ones of the data lines may be calculated, and the porch data for each data line may be generated based on a corresponding one of the average values. The effect of crosstalk caused by the data line may be reduced using the average values of the frame data for data lines.

As shown in FIG. 4A, the porch data for the (K)th data line may be set to an average value of the frame data corresponding to all the pixels connected to the (K)th data line. For example, an average value of the frame data corresponding to all the pixels connected to the first data line DL1 may be calculated. A data signal corresponding to the calculated average value may be applied to the pixels during the porch period. When the average value is calculated using frame data corresponding to all the pixels connected to the (K)th data line, the porch data may be accurately set to an average value of the frame data, and the effect of the crosstalk may be reduced (e.g., minimized) in the porch period. Therefore, it is possible to remove or substantially remove the stripe pattern.

As shown in FIG. 4B, the porch data for the (K)th data line may be set to an average value of the frame data corresponding to ones of the pixels (e.g., predetermined ones of the pixels) connected to the (K)th data line. When the average value is calculated using frame data corresponding to all the pixels connected to the (K)th data line, load of the display device may be increased and a driver may have a relatively large size. Therefore, the porch data for the data line may be set to the average value of the frame data corresponding to ones of the pixels (e.g., predetermined ones of the pixels) connected to the data line to decrease the load of the display device. For example, an average value of the frame data corresponding to odd number pixels connected to the first data line DL1 may be calculated. A data signal corresponding to the calculated average value may be applied to the pixels during the porch period, thereby removing the stripe pattern resulting from crosstalk. Although the example embodiments of FIG. 4B describe that the average value is calculated using half of all the pixels, number of the pixels for calculating the average value may be determined in consideration of the load of the display device.

As shown in FIG. 4C, the porch data for the (K)th data line may be set to an average value of the frame data corresponding to randomly selected ones of the pixels connected to the (K)th data line. When the average value is calculated using frame data corresponding to ones of the pixels (e.g., predetermined ones of the pixels) connected to the (K)th data line, a color pattern on which a total average is significantly different from a sampling average may exist. For example, when the average value (i.e., the sampling average) using ones of the pixels (e.g., predetermined ones of the pixels) is significantly different from the total average value of the frame data, the average value for setting the porch data may not be accurately calculated. Therefore, the porch data for the data line may be set to an average value of the frame data corresponding to randomly selected ones of the pixels connected to the data line, thereby reliably calculating the average value and reducing the load of the display device.

Figure 5A:
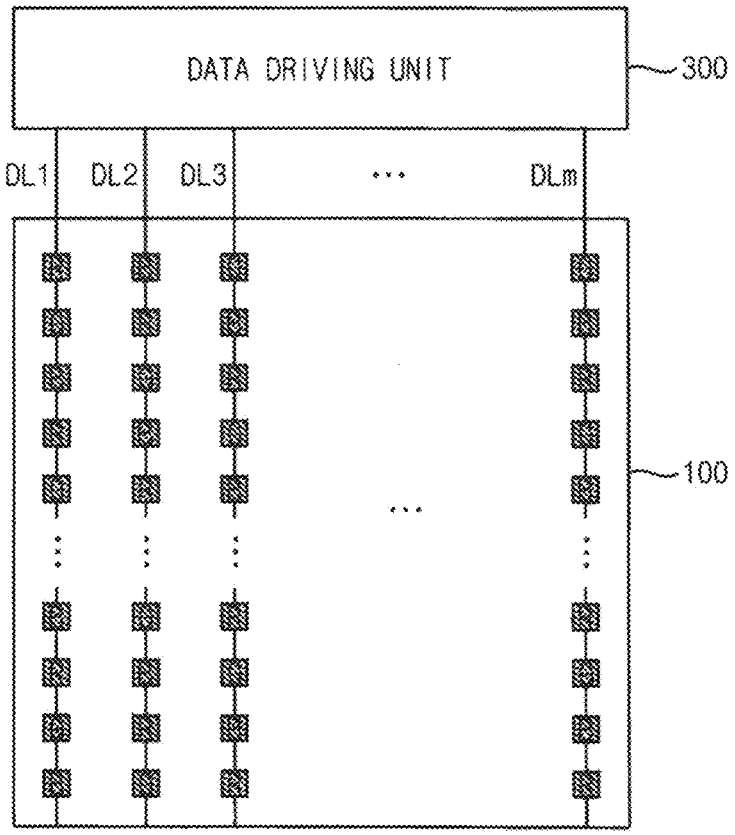
FIGS. 5A through 5C are diagrams illustrating examples of generating porch data by calculating average values of the frame data for pixel groups.
Figure 5B:
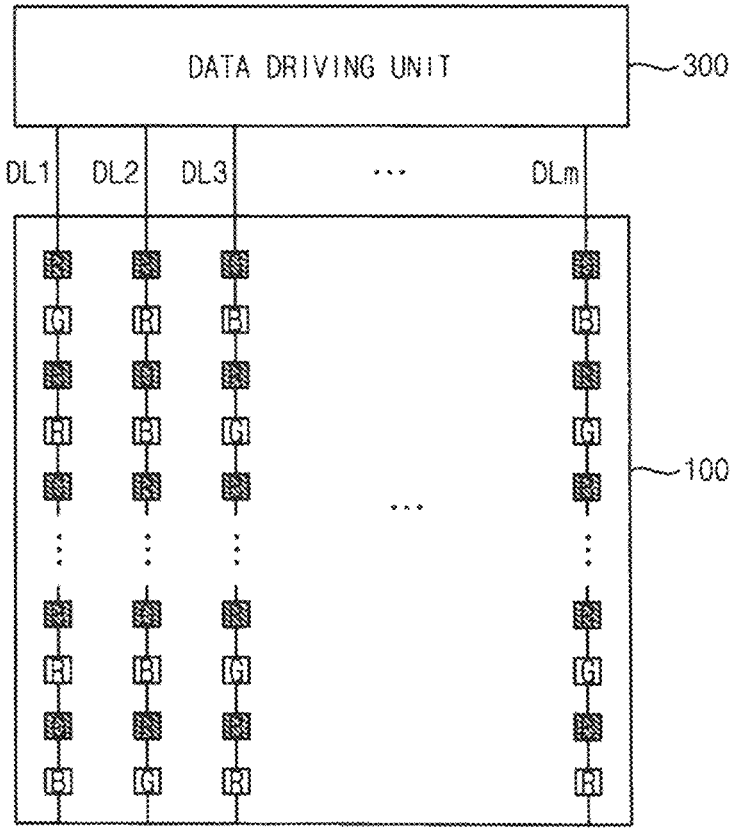
Figure 5C:
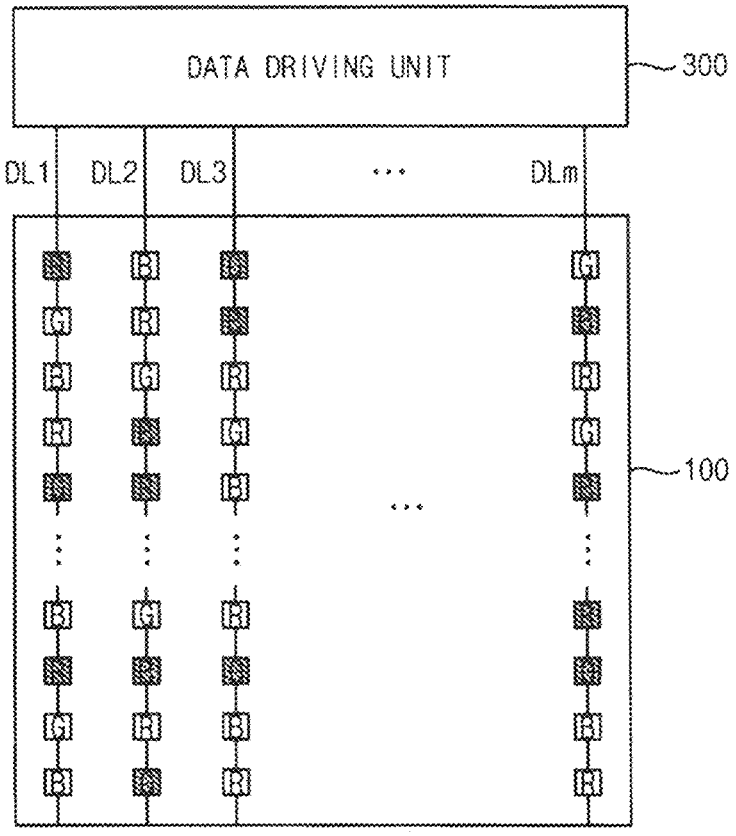

FIGS. 5A through 5C are diagrams illustrating examples of generating porch data by calculating average values of the frame data for pixel groups.

Referring to FIGS. 5A through 5C, pixels may be grouped into a plurality of pixel groups each including pixels emitting a same color light, and the porch data generator 650 may generate the porch data for each pixel group by calculating an average value of the frame data for each pixel group. Because contributions to the luminance of color lights emitted by the display device are different from each other, the porch data for each pixel group may be generated by calculating an average value of the frame data for each pixel group to remove or lessen the stripe pattern due to crosstalk. For example, in the display device displaying an image using a red color light, a blue color light, and a green color light, and in which red color pixel R, green color pixel G, and blue color pixel B are sequentially alternately arranged in data line and scan line direction (i.e., in a mosaic type structure), the porch data is generated by calculating an average value of the frame data for each of pixel groups, each of which includes the pixels emitting one of the red color light, the blue color light, and the green color light.

As shown in FIG. 5A, the porch data may be set to an average value of the frame data corresponding to all the pixels in each pixel group. For example, an average value of the frame data corresponding to all pixels emitting the red color light may be calculated. An average value of the frame data corresponding to all pixels emitting the green color light may be calculated. An average value of the frame data corresponding to all pixels emitting the blue color light may be calculated. The porch data may be generated using the calculated average values. The data signals corresponding to generated porch data may be applied to the pixels during the porch period. The average values of the frame data corresponding to each of the red color pixels, the green color pixels, and the blue color pixels during porch period may be sequentially outputted to remove or lessen the stripe pattern due to crosstalk.

As shown in FIG. 5B, the porch data may be set to an average value of the frame data corresponding to ones of the pixels (e.g., predetermined ones of the pixels) in each pixel group. When the average value is calculated using frame data corresponding to all the pixels in the display panel 100, load of the display device may be increased and size of a driving integrated circuit may be relatively large. Therefore, the porch data may be set to the average value of the frame data corresponding to ones of the pixels (e.g., predetermined ones of the pixels) to decrease the load of the display device. For example, in the display device displaying an image using the red color light, the blue color light, and the green color light, and the red color pixel R, the green color pixel G, the blue color pixel B, which are sequentially alternately arranged in a scan line direction, the average value of the frame data corresponding to the pixels connected to odd scan lines in each pixel group may be calculated. The data signals corresponding to the calculated average values may be applied to the pixels during the porch period, thereby removing or substantially removing the stripe pattern due to crosstalk. Although the example embodiments of FIG. 5B describe that the average value is calculated using half pixels of the pixel group, the number of the pixels for calculating the average value may be determined in consideration of the load of the display device.

As shown in FIG. 5C, the porch data may be set to an average value of the frame data corresponding to randomly selected ones of the pixels in each pixel group. When the average value is calculated using frame data corresponding to ones of the pixels (e.g., predetermined ones of the pixels) in the display panel 100, a color pattern on which a total average is significantly different from a sampling average may exist. For example, when the average value using ones of the pixels (e.g., predetermined ones of the pixels), that is, the sampling average, is significantly different from the total average value of the frame data, the average value for setting the porch data may not be accurately calculated. Therefore, the porch data for each pixel group may be set to an average value of the frame data corresponding to randomly selected ones of the pixels in each pixel group, thereby reliably calculating the average value and reducing the load of the display device.

Figure 6:
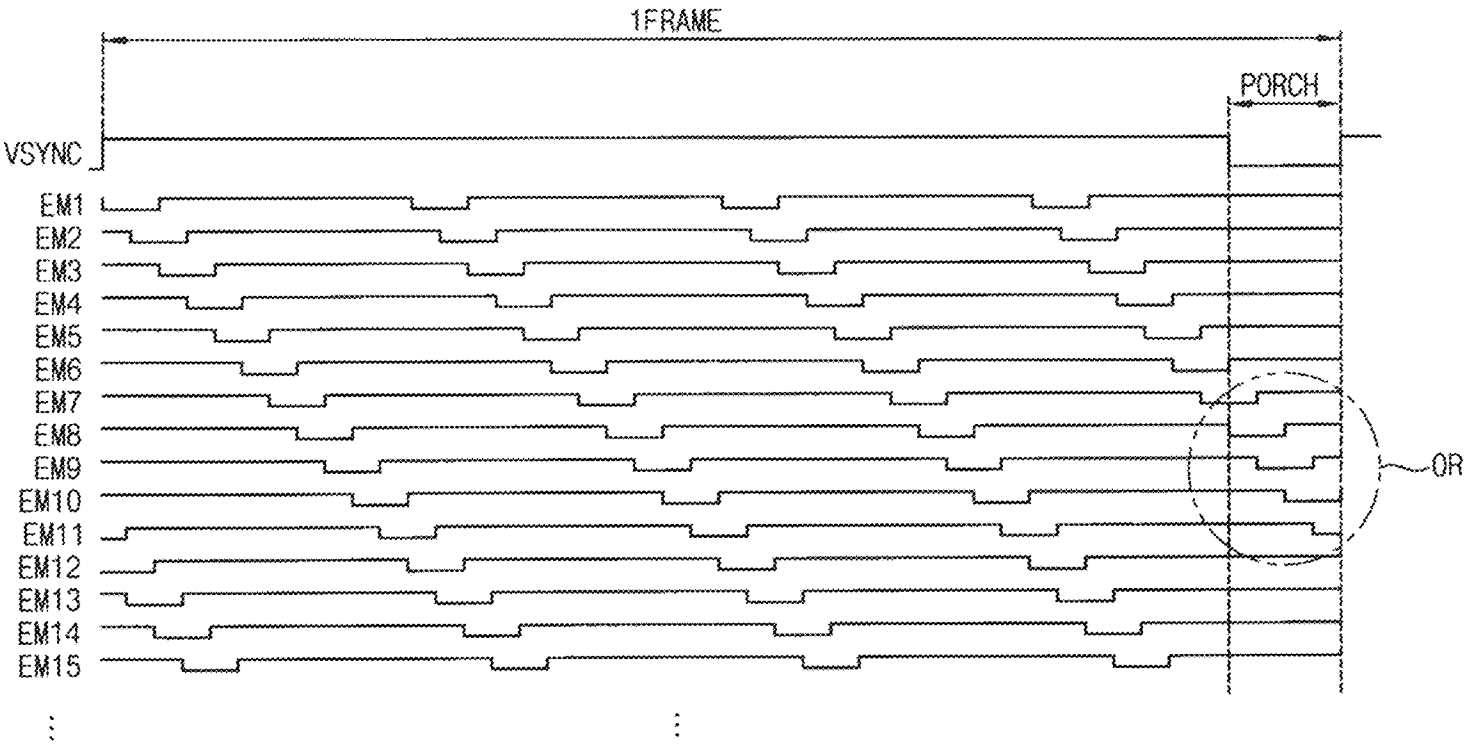
FIG. 6 is a diagram illustrating that the porch period and an on-period of the emission signal are partially overlapped.
Figure 7:
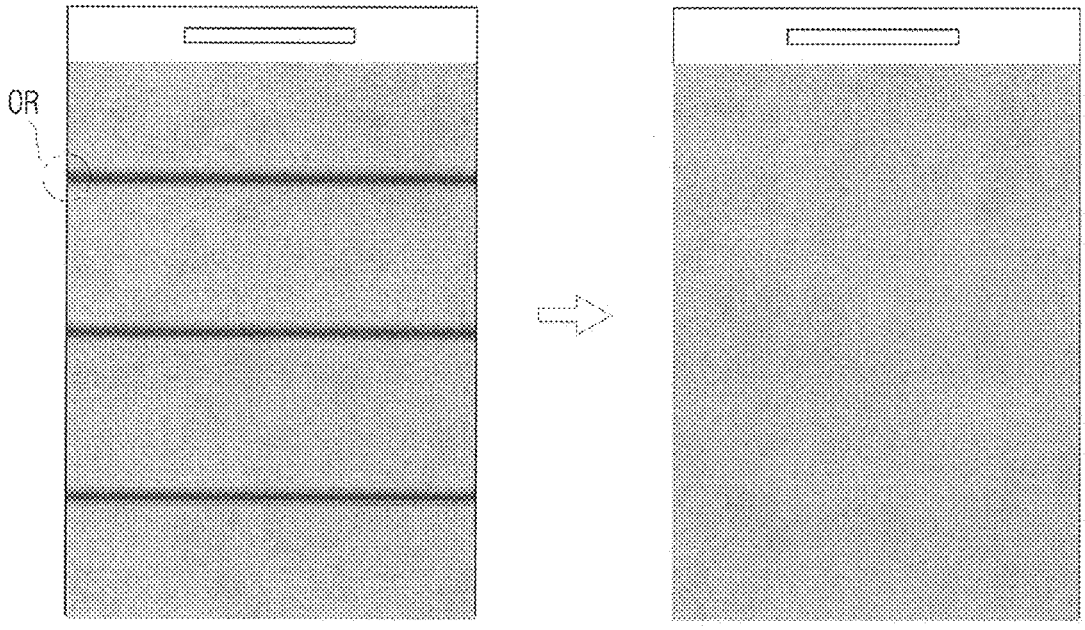
FIG. 7 is a diagram illustrating an example of removing a stripe pattern due to crosstalk in an organic light emitting display device of FIG. 1.

FIG. 6 is a diagram illustrating that the porch period and an on-period of the emission signal are partially overlapped. FIG. 7 is a diagram illustrating an example of removing a stripe pattern due to crosstalk in an organic light emitting display device of FIG. 1.

Referring to FIGS. 6 and 7, when the porch period and an on-period of the emission signal are partially overlapped, the stripe pattern may occur due to crosstalk. However, the stripe pattern may be removed or alleviated by setting the porch data to an average value of at least a portion of the frame data.

As shown in FIG. 6, the organic light emitting display device may perform a dimming operation for controlling an emission time using an emission signal. For example, when each frame period has four on-periods of the emission signal, the porch period PORCH and an on-period of the emission signal are overlapped in seventh through eleventh emission lines EM7 through EM11. Therefore, pixels corresponding to the seventh through eleventh emission lines EM7 through EM11 may be affected by the porch data.

As shown in FIG. 7, when on-period of the emission signal (i.e., the emission period) is set to 1.5% of total period and the display device displays an image having 2nit and 224 grayscale levels, the stripe pattern was removed or lessened. In one comparison embodiment, when the porch data were set to black color data, the dark stripe pattern occurred due to crosstalk in the pixels corresponding to the seventh through eleventh emission lines EM7 through EM11. In another comparison embodiment, when the porch data were set to the last frame data of the previous frame period, the crosstalk between the data line and the G node line was determined according to the last frame data of the previous frame period in the pixels corresponding to the seventh through eleventh emission lines EM7 through EM11. Therefore, the color pattern on which a total average is significantly different from a sampling average may have existed and the stripe pattern was recognized according to the last frame data of previous frame period. Therefore, because crosstalk of the data line in the porch period PORCH is affected by the porch data in the dimming operation mode, change of luminance according to the porch data may be recognized by the viewer. Especially, when the organic light emitting display device displays the image in low luminance driving mode using the dimming technique, change of luminance resulting from crosstalk may be relatively large and the stripe pattern may be readily recognized by the viewer.

On the other hand, in one experimental embodiment, when the porch data for the data line were generated by calculating average values of frame data corresponding to respective ones of the data lines, and the data signals corresponding to the porch data were applied to the pixels, the stripe pattern due to crosstalk was removed or lessened. Thus, the porch data may be set such that a magnitude of crosstalk in a porch emission region OR, of which pixels emit light during the porch period PORCH, is substantially the same or similar to a magnitude of crosstalk in a porch non-emission region, of which pixels do not emit light during the porch period PORCH. Therefore, the change of luminance created in the boundary of the porch emission region OR and the porch non-emission region may be decreased. As a result, the organic light emitting display device may uniformly display the image in the low luminance driving mode and the stripe pattern may not be recognized by the viewer.

The organic light emitting display device may generate the porch data based on the average value of the frame data, thereby reducing the effect of crosstalk by a parasitic capacitor in a data line. Therefore, the organic light emitting display device may alleviate or remove the stripe pattern that is caused by outputting data signals during the porch period PORCH.

Figure 8:
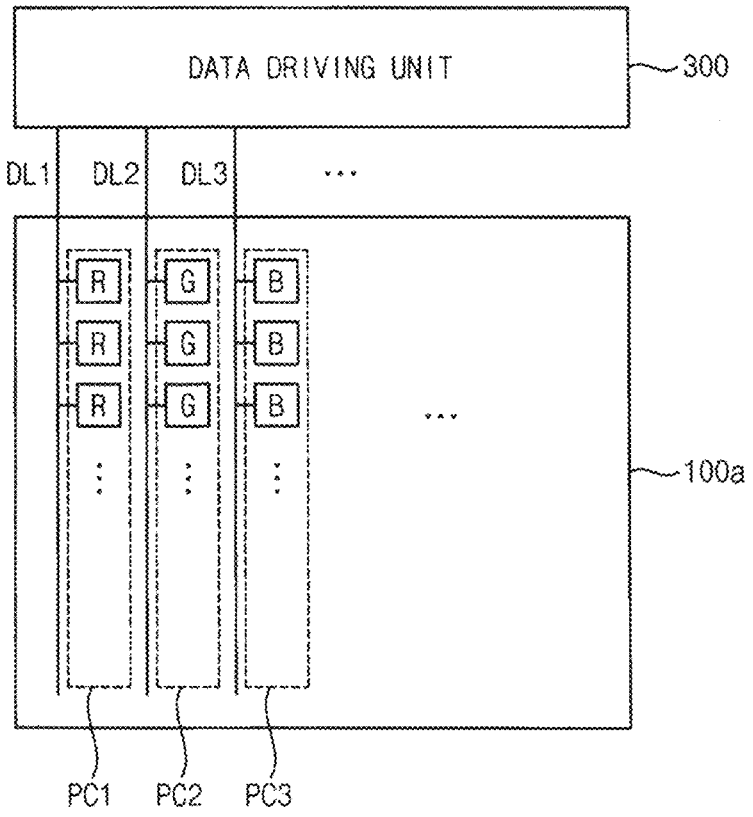
FIG. 8 is a block diagram illustrating one example of pixel arrangement in an organic light emitting display device of FIG. 1.
Figure 9:
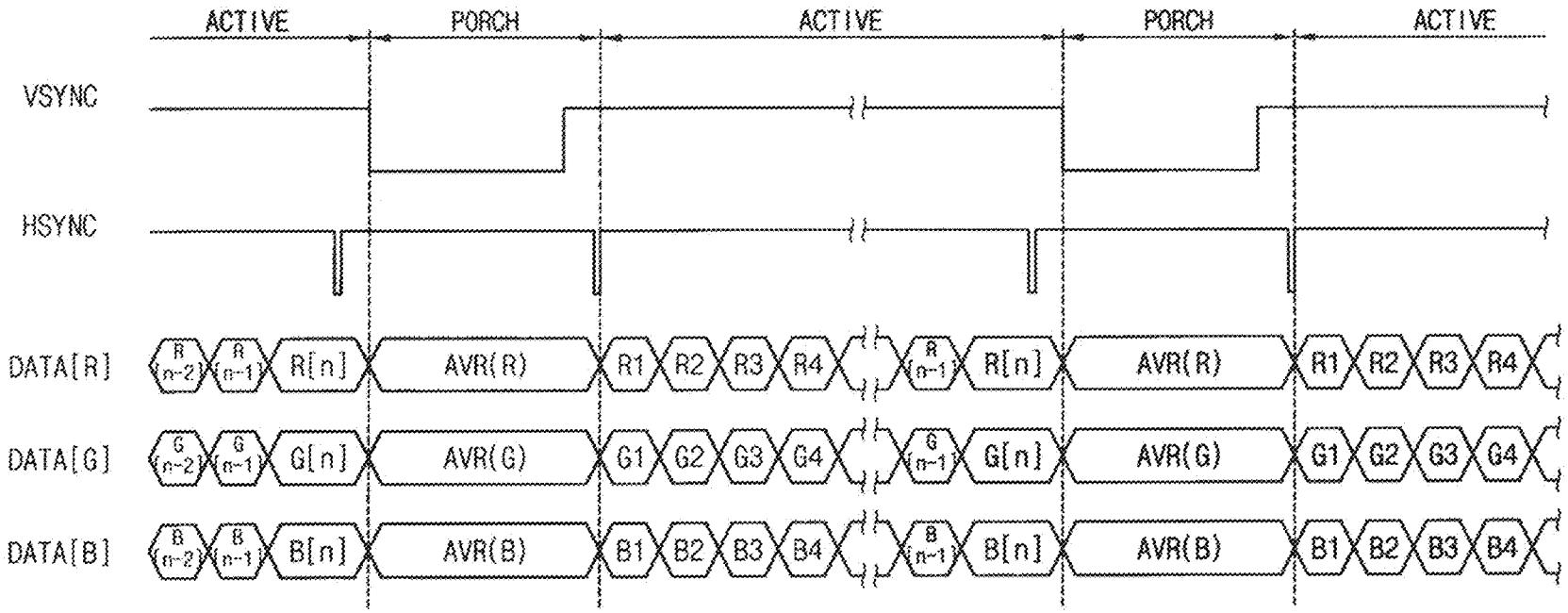
FIG. 9 is a waveform illustrating an example of setting porch data in the pixel arrangement of FIG. 8.

FIG. 8 is a block diagram illustrating one example of pixel arrangement in an organic light emitting display device of FIG. 1. FIG. 9 is a waveform illustrating an example of setting porch data in the pixel arrangement of FIG. 8.

Referring to FIGS. 8 and 9, when the display panel 100*a* may include a plurality of red pixels R, a plurality of green pixels G, and a plurality of blue pixels B that are arranged in a stripe type structure, the porch data may be generated by calculating average values of the frame data for corresponding ones of the column of pixels or color lights.

As shown in FIG. 8, the pixels in the display panel 100*a* may include a first column of pixels PC1 that are connected to a first data line DL1 and emit a first color light, a second column of pixels PC2 that are connected to a second data line DL2 and emit a second color light, and a third column of pixels PC3 that are connected to a third data line DL3 and emit a third color light. The first color light, the second color light, and the third color light may be different from each other. Thus, the display panel 100*a* may include red pixels R, green pixels G, and blue pixels B that are arranged in the stripe type structure such that pixels connected to each data line emit one of the red color light, the green color light, and the blue color light.

As shown in FIG. 9, the porch data may be set to an average value of the frame data to reduce the effect of crosstalk by a parasitic capacitor in a data line.

In some example embodiments, the porch data generator 650 may generate the porch data by calculating average values of the frame data for corresponding ones of the first column of pixels PC1, the second column of pixels PC2, and the third column of pixels PC3. Thus, the porch data generator 650 may generate the porch data by calculating the average values of the frame data for column of pixels that is connected to each of the data lines. In one example embodiment, the first column of pixels PC1 connected to the first data line DL1 may include the red color pixels R, and the porch data for the first column of pixels PC1 may be set to an average value of the frame data corresponding to all the pixels connected to the first column of pixels PC1. In another example embodiment, the porch data for the first column of pixels PC1 may be set to an average value of the frame data corresponding to particular ones (e.g., predetermined ones) or randomly selected ones of the pixels connected to the first column of pixels PC1.

In some example embodiments, the porch data generator 650 may generate the porch data by calculating average values of the frame data for each of the first color light, the second color light, and the third color light. Thus, the porch data generator 650 may generate the porch data by calculating the average values of the frame data for the pixel groups each including pixels emitting a same color light. For example, the average values of the frame data for the pixel group that includes the pixels emitting the red color light may be calculated, and the porch data for the pixel group may be generated based on the calculated average value. In one example embodiment, the porch data for the pixel group may be set to an average value of the frame data corresponding to all the pixels emitting the red color light. In another example embodiment, the porch data for the pixel group may be set to an average value of the frame data corresponding to particular ones (e.g., predetermined ones) or randomly selected ones of the pixels emitting the red color light.

Figure 10:
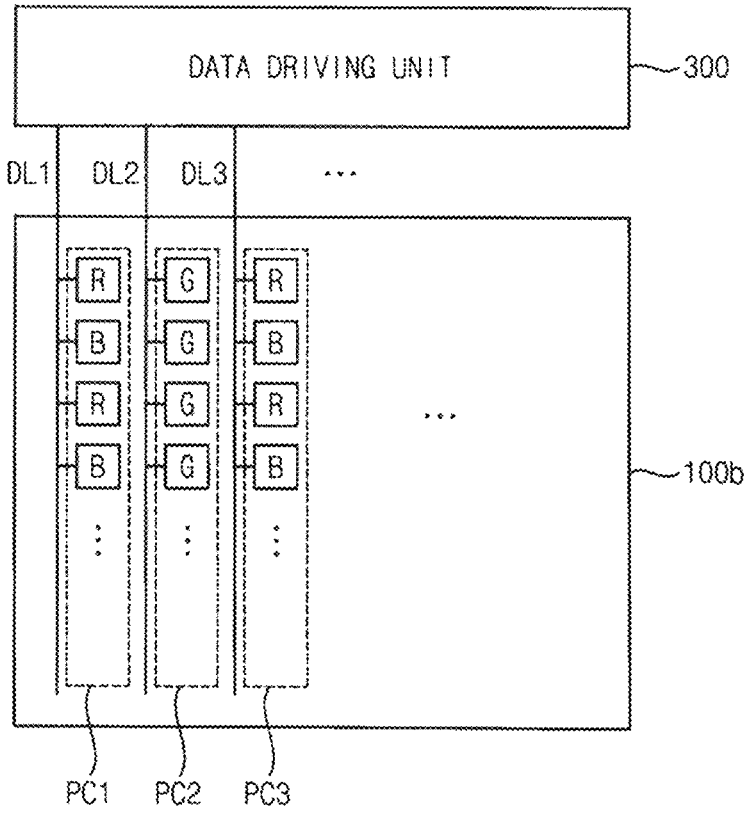
FIG. 10 is a block diagram illustrating another example of pixel arrangement in an organic light emitting display device of FIG. 1.
Figure 11:
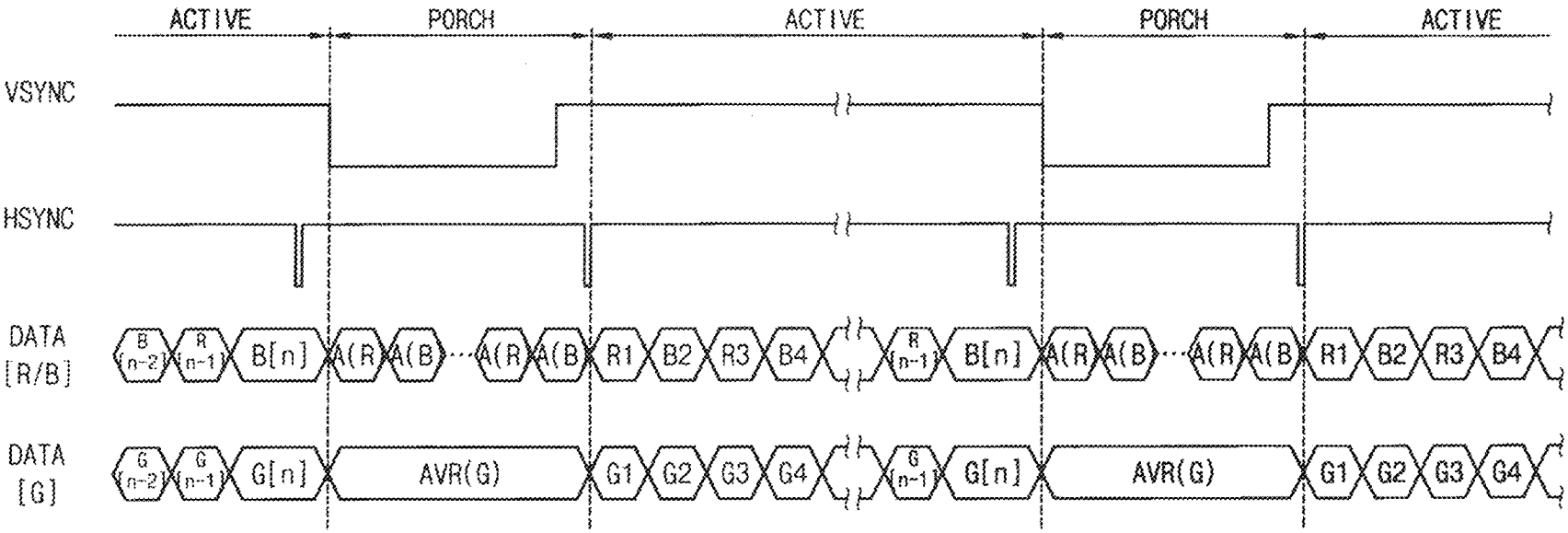
FIG. 11 is a waveform illustrating an example of setting porch data in the pixel arrangement of FIG. 10.

FIG. 10 is a block diagram illustrating another example of pixel arrangement in an organic light emitting display device of FIG. 1. FIG. 11 is a waveform illustrating an example of setting porch data in the pixel arrangement of FIG. 10.

Referring to FIGS. 10 and 11, the display panel 100*b* may include a plurality of red pixels R, a plurality of green pixels G, and a plurality of blue pixels B that are arranged in a pentile type structure. The porch data may be generated by calculating average values of the frame data for corresponding ones of the color lights.

As shown in FIG. 10, the pixels may include a first column of pixels PC1 that are connected to a first data line DL1 and alternately emits a first color light and a second color light, and a second column of pixels PC2 that are connected to a second data line DL2 and emits a third color light. The first color light, the second color light, and the third color light may be a red color light, a blue color light, and a green color light, respectively. The display panel 100*b* having the pentile type structure may reduce the number of the red color pixels R and the blue color pixels B by half in comparison with the display panel having the stripe type structure. Therefore, the display panel 100*b* having the pentile type structure may reduce the number of total pixels by ⅔ in comparison with the display panel having the stripe type structure, thereby increasing the opening ratio of the display panel 100*b*. In addition, the display panel 100*b* having the pentile type structure may perform a rendering operation to have the same or substantially the same perceived resolution as the display panel having the stripe type structure.

As shown in FIG. 11, the porch data generator 650 may generate the porch data by calculating average values of the frame data for corresponding ones of the first color light, the second color light, and the third color light. The porch data for the first column of pixels PC1 may be alternately set to an average value of the frame data corresponding to the first color light and an average value of the frame data corresponding to the second color light. The porch data for the second column of pixels PC2 may be set to an average value of the frame data corresponding to the third color light. For example, the first column of pixels PC1 connected to the first data line DL1 may include the red color pixels R and the blue color pixels B. The porch data for the first column of pixels PC1 may be alternately set to an average value of the frame data corresponding to the red color pixels R connected to the first column of pixels PC1 and an average value of the frame data corresponding to the blue color pixels B connected to the first column of pixels PC1. Therefore, the first data line DL1 may receive the same or substantially the same voltage as the average value of the first data line DL1 in the porch period PORCH, thereby reducing (e.g., minimizing) a change of luminance by the coupling effects. In addition, the second column of pixels PC2 connected to the second data line DL2 may include the green color pixels G. The porch data for the second column of pixels PC2 may be set to an average value of the frame data corresponding to the green color pixels G connected to the second column of pixels PC2.

Figure 12:
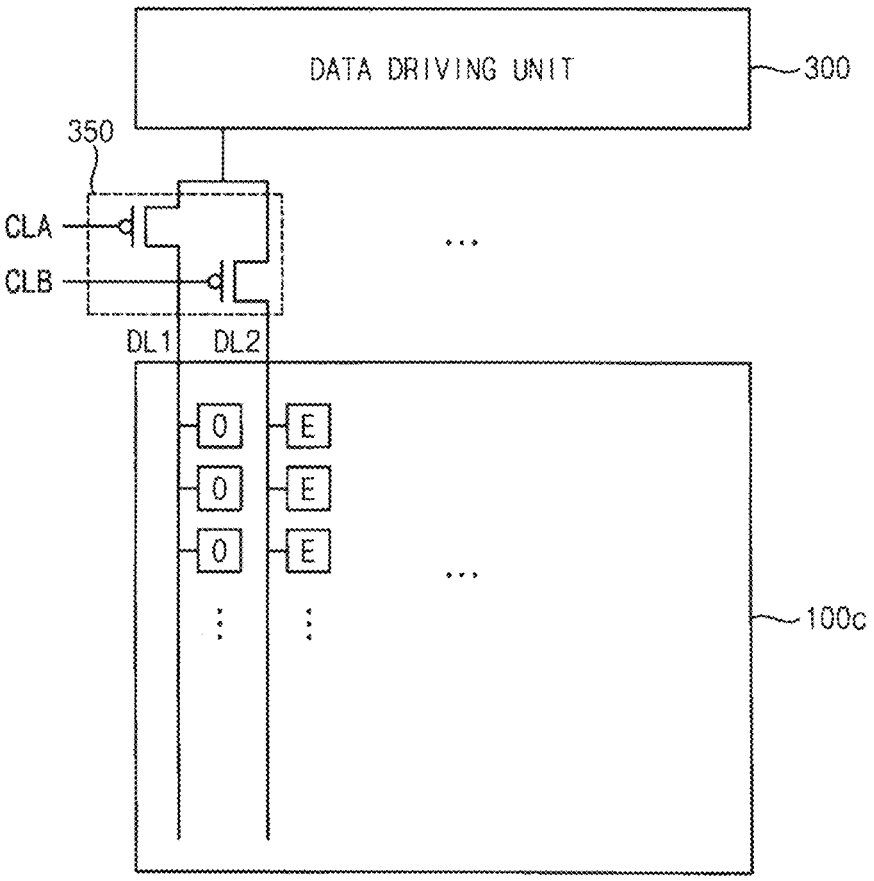
FIG. 12 is a block diagram illustrating still another example of pixel arrangement in an organic light emitting display device of FIG. 1.
Figure 13:
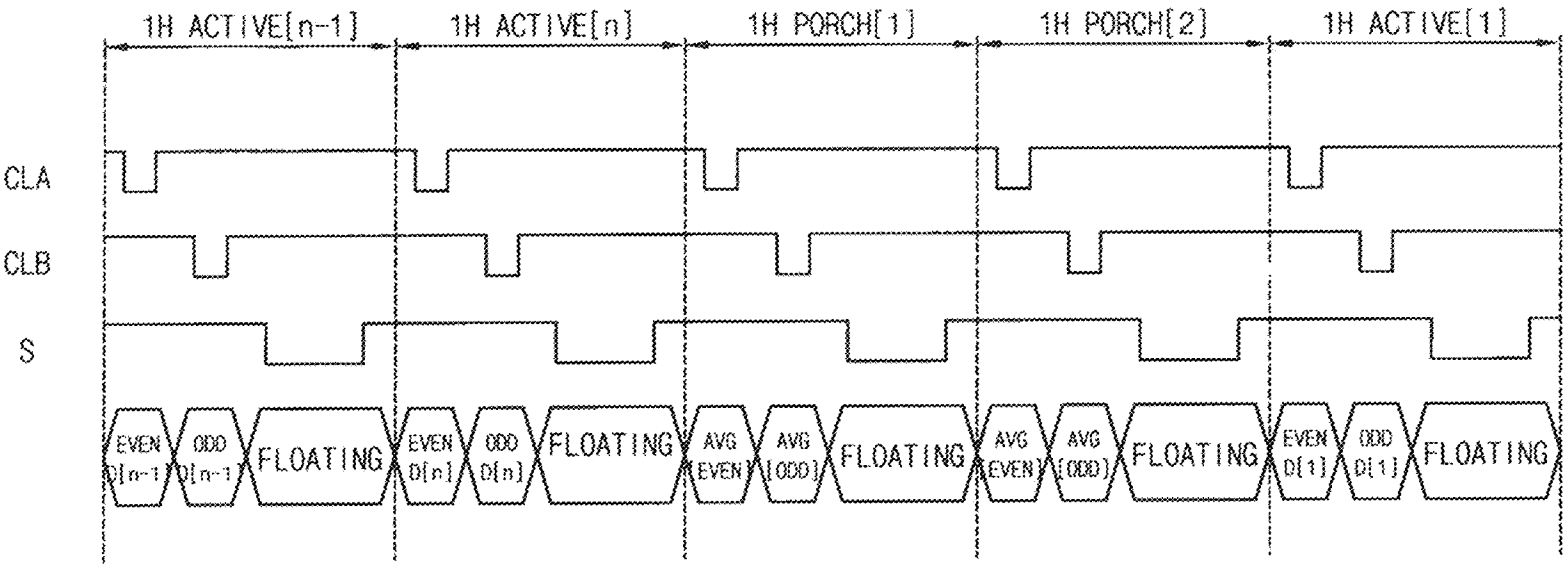
FIG. 13 is a waveform illustrating an example of setting porch data in the pixel arrangement of FIG. 12.

FIG. 12 is a block diagram illustrating still another example of pixel arrangement in an organic light emitting display device of FIG. 1. FIG. 13 is a waveform illustrating an example of setting porch data in the pixel arrangement of FIG. 12.

Referring to FIGS. 12 and 13, the organic light emitting display device may include a line selector (e.g., a line selection unit) 350. The porch data for each data line may be generated by calculating an average value of the frame data corresponding to the pixels connected to each data line. Data signals corresponding to the porch data for selected ones of the data lines may be applied to the pixels connected to selected ones of the data lines.

As shown in FIG. 12, the organic light emitting display device may include the line selector 350. The line selector 350 may be connected between the data driver 300 and the display panel 100*c*. The line selector 350 may selectively provide the data signals to first ones DL1 of the data lines and second ones DL2 of the data lines in response to a line selection signal CLA or CLB. In one example embodiment, the line selector 350 may include a demultiplexer for selecting the data lines. The organic light emitting display device including the line selector 350 may reduce the number of amplifiers connected to an output terminal, thereby reducing manufacturing cost of the organic light emitting display device.

As shown in FIG. 13, the porch data generator 650 may generate the porch data for the first ones of the data lines by calculating an average value of the frame data corresponding to the pixels connected to the first ones of the data lines. Also, the porch data generator 650 may generate the porch data for the second ones of the data lines by calculating an average value of the frame data corresponding to the pixels connected to the second ones of the data lines. Thus, the porch data may be set to the average value of the frame data corresponding to the data lines. For example, while the line selector 350 selects a first data line DL1 in the first porch period PORCH[1], the data signal corresponding to the porch data for the first data line DL1 may be provided to the first data line DL1. Thereafter, while the line selector 350 selects a second data line DL2 in the first porch period PORCH[1], the data signal corresponding to the porch data for the second data line DL2 may be provided to the second data line DL2. Therefore, the line selection signal CLA and CLB may be applied to the line selector 350 in the first porch period PORCH[1] and the second porch period PORCH[2]

like the (N)th active period ACTIVE[N]. The porch data may be set to average values of frame data for the corresponding ones of the data lines or the color lights, thereby reducing the effect of crosstalk.

Figure 14:
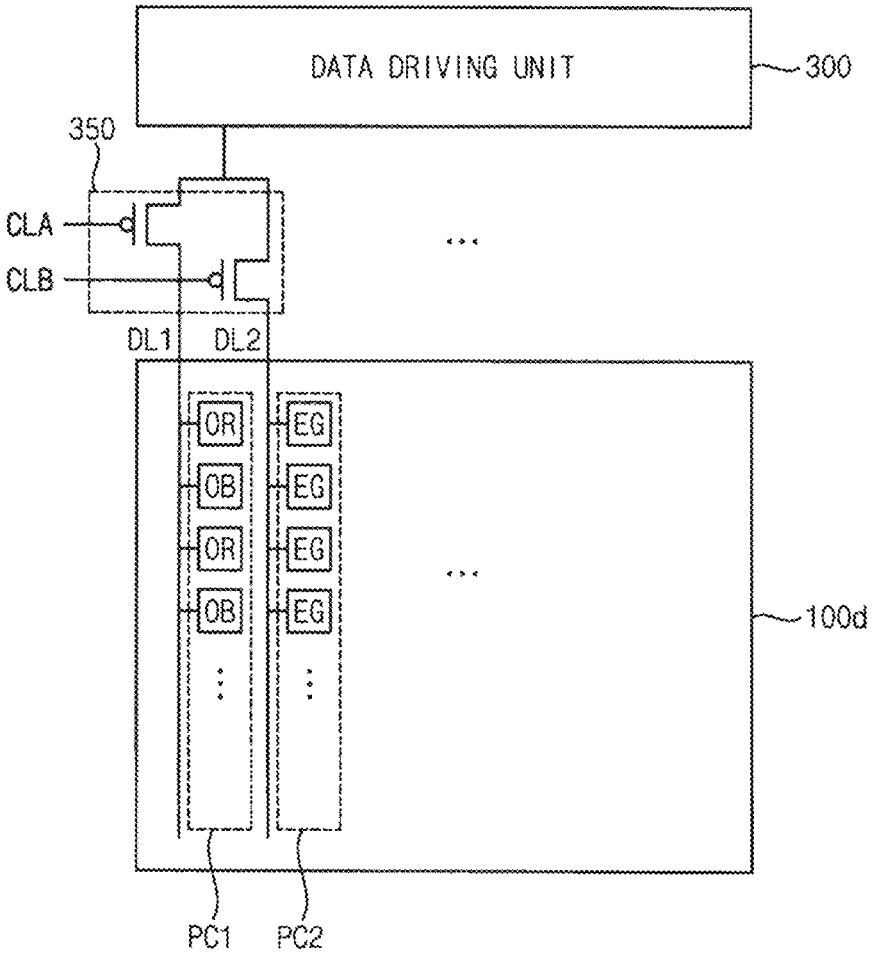
FIG. 14 is a block diagram illustrating still another example of pixel arrangement in an organic light emitting display device of FIG. 1.
Figure 15:
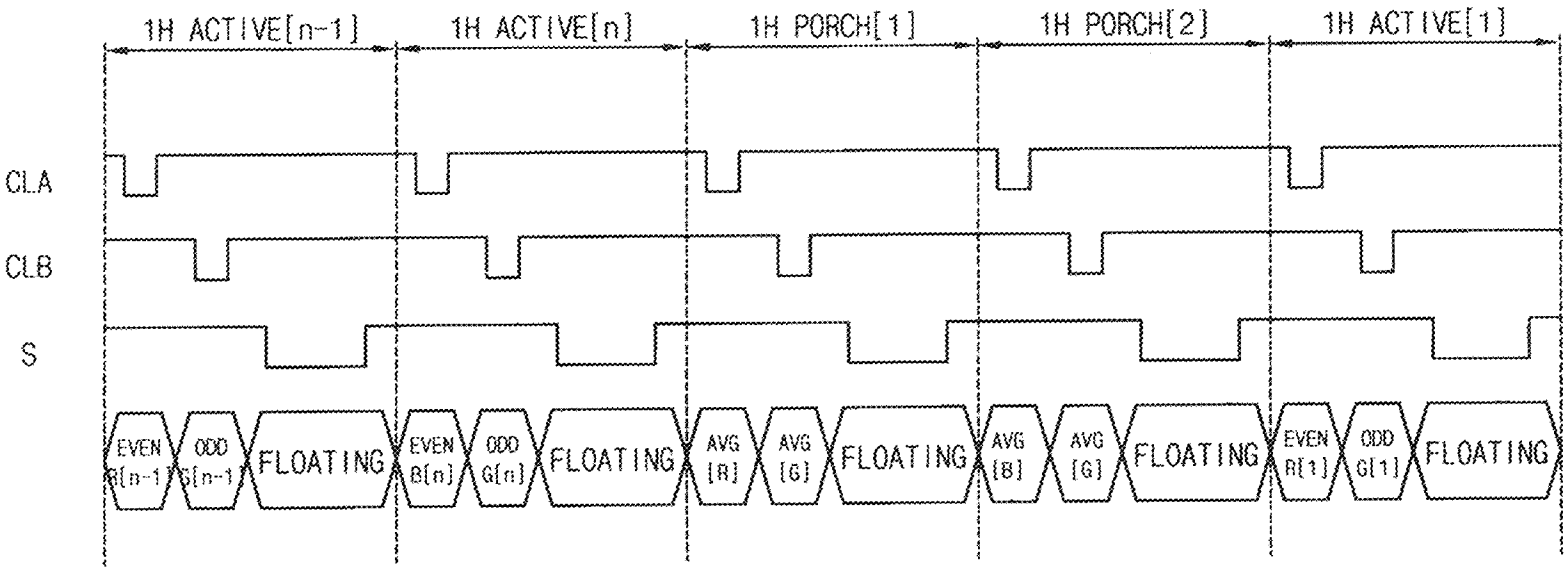
FIG. 15 is a waveform illustrating an example of setting porch data in the pixel arrangement of FIG. 14.

FIG. 14 is a block diagram illustrating still another example of pixel arrangement in an organic light emitting display device of FIG. 1. FIG. 15 is a waveform illustrating an example of setting porch data in the pixel arrangement of FIG. 14.

Referring to FIGS. 14 and 15, the organic light emitting display device may include a line selector 350 and pixels arranged in a pentile type structure. The porch data for each data line may be generated by calculating average values of the frame data for corresponding ones of the data lines. Data signals corresponding to the calculated porch data may be applied to the pixels connected to selected ones of the data lines.

As shown in FIG. 14, the organic light emitting display device may further include the line selector 350. The line selector 350 may be connected between the data driver 300 and the display panel 100*d*. The line selector 350 may selectively provide the data signals to first ones DL1 of the data lines and second ones DL2 of the data lines in response to a line selection signal CLA or CLB. The pixels may include a first column of pixels PC1 that are connected to a first data line DL1 and alternately emits a first color light and a second color light, and a second column of pixels PC2 that are connected to a second data line DL2 and emits a third color light. The first color light, the second color light, and the third color light may be a red color light, a blue color light, and a green color light, respectively.

As shown in FIG. 15, the porch data generator 650 may generate the porch data for the first data line DL1 by calculating an average value of the frame data for the red color pixels R and an average value of the frame data for the blue color pixels B. Also, the porch data generator 650 may generate the porch data for the second data line DL2 by calculating an average value of the frame data for the blue color pixels B. When the line selector 350 selects the first data line DL1 in the first porch period PORCH[1], the data signal corresponding to the porch data for the first data line DL1 may be applied to the first data line DL1. When the line selector 350 selects the second data line DL2 in the first porch period PORCH[1], the data signal corresponding to the porch data for the second data line DL2 may be applied to the second data line DL2. Thereafter, when the line selector 350 selects the first data line DL1 in the second porch period PORCH[2], the data signal corresponding to the porch data for the first data line DL1 may be applied to the first data line DL1. When the line selector 350 selects the second data line DL2 in the second porch period PORCH[2], the data signal corresponding to the porch data for the second data line DL2 may be applied to the second data line DL2. Therefore, the line selection signal CLA and CLB may be applied to the line selector 350 in the first porch period PORCH[1] and the second porch period PORCH[2] like the (N)th active period ACTIVE[N]. The porch data may be set to an average value of the frame data for the data lines, thereby reducing the effect of crosstalk.

Figure 16:
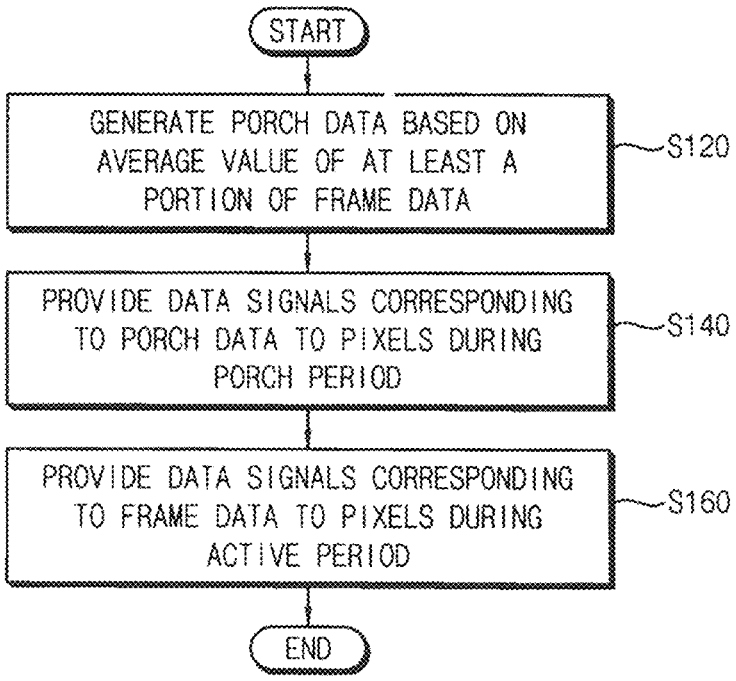
FIG. 16 is a flow chart illustrating a method of driving an organic light emitting display device according to one example embodiment.

FIG. 16 is a flow chart illustrating a method of driving an organic light emitting display device according to one example embodiment.

Referring to FIG. 16, porch data may be generated based on an average value of at least a portion of the frame data (block S120). In one example embodiment, porch data may be generated by calculating the average value of frame data in every frame period.

In some example embodiments, the porch data for each data line may be set to an average value of the frame data corresponding to each data line. In one example embodiment, the porch data for each data line may be set to an average value of the frame data corresponding to all pixels connected to each data line. In another example embodiment, the porch data for each data line may be set to an average value of the frame data corresponding to ones of the pixels (e.g., predetermined ones of the pixels) connected to each data line. In still another example embodiment, the porch data for each data line may be set to an average value of the frame data corresponding to randomly selected ones of the pixels connected to each data line.

In some example embodiments, the pixels are grouped into a plurality of pixel groups each including pixels emitting a same color light. The porch data for each pixel group may be set to an average value of the frame data corresponding to each pixel group. In one example embodiment, the porch data for each pixel group may be set to an average value of the frame data corresponding to ones of the pixels (e.g., predetermined ones of the pixels) in each pixel group. In another example embodiment, the porch data for each pixel group may be set to an average value of the frame data corresponding to randomly selected ones of the pixels in each pixel group.

Because methods of generating the porch data based on an average value of at least a portion of the frame data are described above, duplicated descriptions may not be provided.

Data signals corresponding to the porch data may be provided to the pixels during a porch period (block S140). Data signals corresponding to the frame data may be provided to the pixels during an active period (block S160). For example, the data signal corresponding to the porch data may be applied to the pixels in porch period such that an average voltage of the first data line is applied to the pixels in the porch period, thereby reducing effects of coupling.

For example, when the organic light emitting display device emits light in the porch period, a magnitude of crosstalk in the data line may be affected by the porch data. When the magnitude of crosstalk in a porch emission region of which pixels emit light during the porch period PORCH is significantly different from a magnitude of crosstalk in a porch non-emission region of which pixels do not emit light during the porch period, stripe patterns may be recognized by a viewer. Especially, when the organic light emitting display device displays the image in low luminance driving mode using the dimming technique, change of luminance due to crosstalk may be relatively large and the stripe pattern may be readily recognized by the viewer. Therefore, the porch data may be generated based on the average value of at least a portion of the frame data. Data signal corresponding to the porch data may be applied to the pixels in the porch period. As a result, the magnitude of crosstalk in the porch emission region may be substantially the same or similar to the magnitude of crosstalk in the porch non-emission region, thereby removing the stripe patterns.

Therefore, the method for driving the organic light emitting display device may remove or reduce the stripe pattern and improve (e.g., increase) a display quality in the low luminance driving mode using the dimming technique.

Although the example embodiments describe that the display panel includes red color pixels, green color pixels, and blue color pixels, the display panel may further include white color pixels, etc. Also, the pixels may be arranged in a variety of structures.

The present inventive concept may be applied to an electronic device having the organic light emitting display device. For example, the present inventive concept may be applied to a cellular phone, a smart phone, a smart pad, a personal digital assistant (PDA), etc.

The foregoing is illustrative of example embodiments and is not to be construed as limiting thereof. Although a few example embodiments have been described, those skilled in the art will readily appreciate that many suitable modifications are possible in the example embodiments without materially departing from the novel teachings and advantages of the present inventive concept. Accordingly, all such modifications are intended to be included within the scope of the present inventive concept as defined in the claims, and equivalents thereof. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

What is claimed is:

1. An organic light emitting display device comprising:

a display panel comprising a plurality of scan lines, first through (M)th data lines crossing the scan lines, and a plurality of pixels, where M is an integer greater than 1;

a scan driver configured to provide scan signals to the pixels through the plurality of scan lines;

a data driver configured to provide data signals to the pixels through the first through (M)th data lines; and a porch data generator configured to generate porch data based on an average value of at least a portion of frame data, and to provide the porch data to the data driver, wherein the data driver is configured to generate the data signals based on the porch data during a porch period, and to generate the data signals based on the frame data during an active period, wherein the porch data generator is configured to generate the porch data for a (K)th data line of the data lines by calculating an average value of the frame data for the (K)th data line, where K is an integer between 1 and M, and wherein the porch data generator is further configured to set the porch data for the (K)th data line to an average value of the frame data corresponding to randomly selected ones of the pixels connected to the (K)th data line.

2. The display device of claim 1, wherein the pixels comprise a first column of pixels connected to a first data line of the data lines and configured to emit a first color light, a second column of pixels connected to a second data line of the data lines and configured to emit a second color light, and a third column of pixels connected to a third data line of the data lines and configured to emit a third color light, and wherein the first color light, the second color light, and the third color light are different from each other.

3. The display device of claim 2, wherein the porch data generator is further configured to generate the porch data by calculating average values of the frame data for corresponding ones of the first column of pixels, the second column of pixels, and the third column of pixels.

4. The display device of claim 2, wherein the porch data generator is further configured to generate the porch data by calculating average values of the frame data for corresponding ones of the first color light, the second color light, and the third color light.

5. The display device of claim 1, wherein the pixels comprise a first column of pixels connected to a first data line of the data lines and configured to alternately emit a first color light and a second color light, and a second column of pixels connected to a second data line of the data lines and configured to emit a third color light, wherein the first color light, the second color light, and the third color light are a red color light, a blue color light, and a green color light, respectively, wherein the porch data generator is further configured to generate the porch data by calculating average values of the frame data for corresponding ones of the first color light, the second color light, and the third color light, wherein the porch data generator is further configured to alternately set the porch data for the first column of pixels to an average value of the frame data corresponding to the first color light and an average value of the frame data corresponding to the second color light, and wherein the porch data generator is further configured to set the porch data for the second column of pixels to an average value of the frame data corresponding to the third color light.

6. The display device of claim 1, further comprising:

a line selector connected between the data driver and the display panel, wherein the line selector is configured to selectively provide the data signals to first ones of the data lines and second ones of the data lines in response to a line selection signal.

7. The display device of claim 6, wherein the porch data generator is further configured to generate the porch data for the first ones of the data lines by calculating an average value of the frame data corresponding to one of the pixels connected to the first ones of the data lines, and to generate the porch data for the second ones of the data lines by calculating an average value of the frame data corresponding to ones of the pixels connected to the second ones of the data lines.

8. The display device of claim 1, further comprising:

an emission driver configured to provide an emission signal to the pixels, wherein the porch period and an on-period of the emission signal are partially overlapped.

9. An organic light emitting display device comprising:

a display panel comprising a plurality of scan lines, first through (M)th data lines crossing the scan lines, and a plurality of pixels, where M is an integer greater than 1;

a scan driver configured to provide scan signals to the pixels through the plurality of scan lines;

a data driver configured to provide data signals to the pixels through the first through (M)th data lines; and a porch data generator configured to generate porch data based on an average value of at least a portion of frame data, and to provide the porch data to the data driver, wherein the data driver is configured to generate the data signals based on the porch data during a porch period, and to generate the data signals based on the frame data during an active period, wherein the plurality of pixels are grouped into a plurality of pixel groups each comprising ones of the pixels emitting a same color light, and wherein the porch data generator is further configured to generate the porch data for each pixel group by calculating an average value of the frame data for each pixel group.

10. The display device of claim 9, wherein the porch data generator is further configured to set the porch data to an average value of the frame data corresponding to ones of the pixels in each pixel group.

11. The display device of claim 9, wherein the porch data generator is further configured to set the porch data to an average value of the frame data corresponding to randomly selected ones of the pixels in each pixel group.

12. A method for driving an organic light emitting display device comprising a plurality of pixels, the method comprising:

generating porch data, by a porch data generator, based on an average value of at least a portion of frame data;

providing data signals, by a data driver, corresponding to the porch data to the pixels during a porch period; and providing the data signals, by the data driver, corresponding to the frame data to the pixels during an active period, wherein the plurality of pixels are grouped into a plurality of pixel groups each comprising the pixels emitting a same color light, and wherein generating the porch data comprises:

calculating, by the porch data generator, average values of the frame data for corresponding ones of the pixel groups; and generating, by the porch data generator, porch data for each pixel group based on a corresponding one of the average values.

* * * * *